United States Patent [19]

Diggs

[11] 3,961,832

[45] June 8, 1976

[54] LIGHTWEIGHT ELECTRICAL CABLE

[76] Inventor: Richard E. Diggs, 12 A Road, Carthage, Mo. 64836

[22] Filed: Mar. 12, 1975

[21] Appl. No.: 557,679

[52] U.S. Cl. ..... 339/29 B; 29/629; 29/630 A; 174/75 R; 174/129 R; 339/228

[51] Int. Cl.[2] ..... H01R 11/12

[58] Field of Search ..... 29/629, 630 R, 630 A, 29/630 D, 630 G; 174/75, 128, 129; 339/19, 222, 28, 29, 224–240, 242, 277, 278

[56] References Cited

UNITED STATES PATENTS

| | | | |
|---|---|---|---|
| 2,322,388 | 6/1943 | Powledge | 339/228 |
| 2,462,993 | 3/1949 | Peters et al. | 339/277 |
| 2,615,946 | 10/1952 | Katzman | 29/630 D |
| 3,010,113 | 11/1961 | Tate | 206/303 |

*Primary Examiner*—Roy Lake
*Assistant Examiner*—Neil Abrams
*Attorney, Agent, or Firm*—Shoemaker and Mattare, Ltd.

[57] ABSTRACT

A lightweight electrical cable comprises a plurality of laminations of loops of continuous strips of silver foil, defining an opening at least at one end thereof for receiving a battery post or other electrical connector, and a spring clip engagable with the cable end received on an electrical connector to readily releasably secure the cable in place. The method of making an electrical cable as described above is also disclosed.

9 Claims, 8 Drawing Figures

LIGHTWEIGHT ELECTRICAL CABLE

BACKGROUND OF THE INVENTION

This invention relates to electrically conductive cables, and in particular, to an electrically conductive cable which is lightweight and yet is strong and which is capable of conducting a maximum amount of electrical current.

There are many applications in which such lightweight yet strong and efficient electrical cables are desirable or necessary. For example, in the aerospace industry, the use of electrical power sources and conducting cables in satellites and space capsules is common, and it is essential in such applications that the electrically conductive cables be lightweight, and yet that they be efficient and strong and have means for effecting secure connection of the cables to electrical terminals or connectors. Moreover, lightweight, yet strong and efficient electrical cables are necessary and/or desirable in the computer industry and in many other applications. Further, it is desirable that the electrical cable be economical and simple to manufacture.

OBJECTS OF THE INVENTION

Accordingly, it is an object of this invention to provide a lightweight, yet strong and efficient electrical cable which is both simple in construction and economical to manufacture.

Another object of the invention is to provide a lightweight, yet strong and efficient electrical cable wherein the cable is made of a plurality of laminated loops of silver foil, and the loops are separated to define an opening at least at one end of the cable for receiving an electrical connector.

A further object of the invention is to provide a lightweight, yet strong and efficient electrical cable comprising a plurality of laminated loops of a continuous strip of silver foil.

A still further object is to provide in combination a lightweight, yet strong and efficient electrical cable having a loop or opening at least at one end thereof received on a substantially circular electrical connector, and wherein a resiliently yieldable spring clip means is engaged on the end of the cable, clamping it to the connector.

A still further object of this invention is to provide a method of making the electrical connector as described herein.

DETAILED DESCRIPTION OF THE INVENTION

Figure 1:
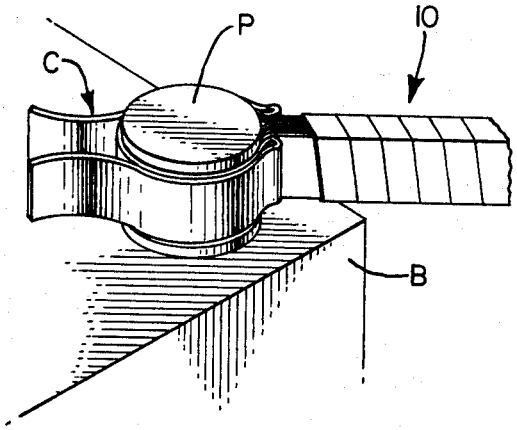
FIG. 1 is a fragmentary, top perspective view of a portion of the cable in accordance with the invention shown attached to a battery post of a battery.
Figure 2:
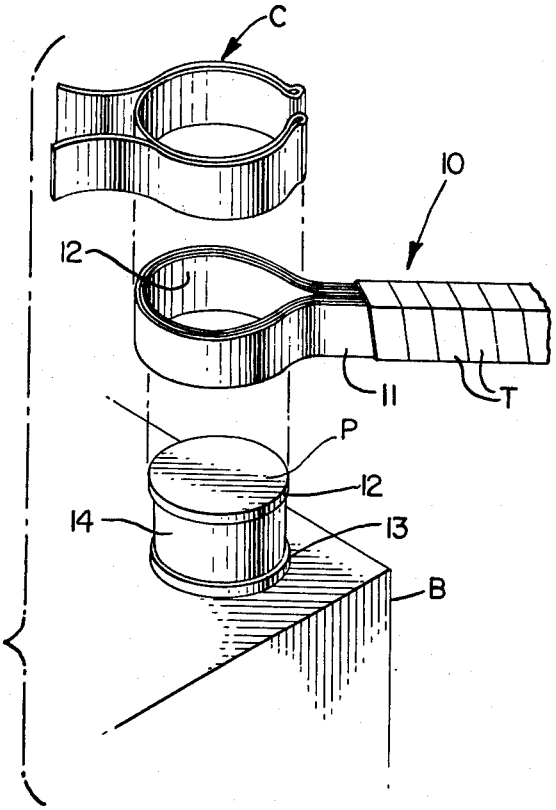
FIG. 2 is an exploded, perspective view of the cable, spring clip and battery and battery post of FIG. 1.
Figure 3:
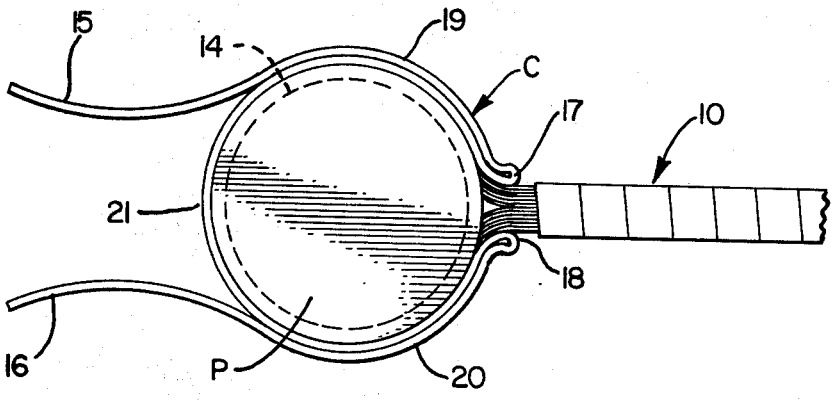
FIG. 3 is an enlarged plan view of the cable, spring clip and electrical connector according to the invention.
Figure 4:
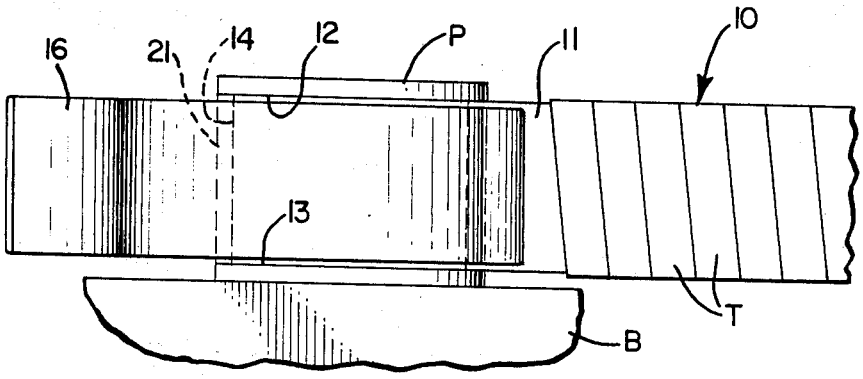
FIG. 4 is a side view in elevation of the structure shown in FIG. 3.

In the drawings, wherein like reference numerals indicate like parts throughout the several views, a cable 10 is connected to the post P of a battery B by means of a spring clip C. The cable 10 comprises a plurality of laminated loops 11 of a continuous strip of silver foil, and wherein the loops are pressed together between the ends thereof, and at opposite ends of the cable the loops are spaced apart to define an electrical connector receiving opening 12 therebetween. If desired, the cable may be helically wrapped with tape T or other suitable material between the ends thereof to maintain the laminated loops in tightly compressed engagement with one another.

The electrical connector or post P, as, for example. on the battery B, comprises an upstanding post having a substantially circular cross section, and with a pair of spaced shoulders 12 and 13 at the upper and lower ends thereof, respectively, defining an annular recess 14 therebetween over which the open or looped end of cable 10 is received. The vertical extent of the recess 14 is substantially the same as the width of the cable 10, whereby when the post P is received through the opening 12, the laminated silver foil snugly engages the material of the post between the shoulders, and the upper and lower edges of the cable engage against the shoulders 12 and 13 to prevent arcing between the post and cable. In order to securely, yet releasably connect the cable to the post, the spring clip C is preferably made of spring steel, although it could be made of other materials having a natural resiliency, and the clip C comprises an elongate strip of spring steel, having the opposite end portions therof formed to define finger gripping portions 15 and 16 disposed in spaced apart, substantially parallel relationship to one another. The strip of spring steel or other suitable material is bent reversely upon itself between the ends thereof to define opposed, confronting ends 17 and 18 of spaced apart, arcuate jaws 19 and 20, and the ends 17 and 18 of the jaws are joined by a substantially circularly shaped loop 21 of the material, which engages the post P within the recess 14.

With this construction, the finger engaging portions 15 and 16 are grasped and pressed toward one another, with the result that the ends 17 and 18 of the jaws move relatively apart, thus enabling the spring clip C to be placed over the looped portion of the cable which is received on the post P, and the finger engaging portions are then released, whereby the jaws of the spring clip tightly engage the cable, pressing it against the post substantially completely around the circumference of the post, and accordingly, effecting a secure electrical connection between the post and cable.

Figure 5:
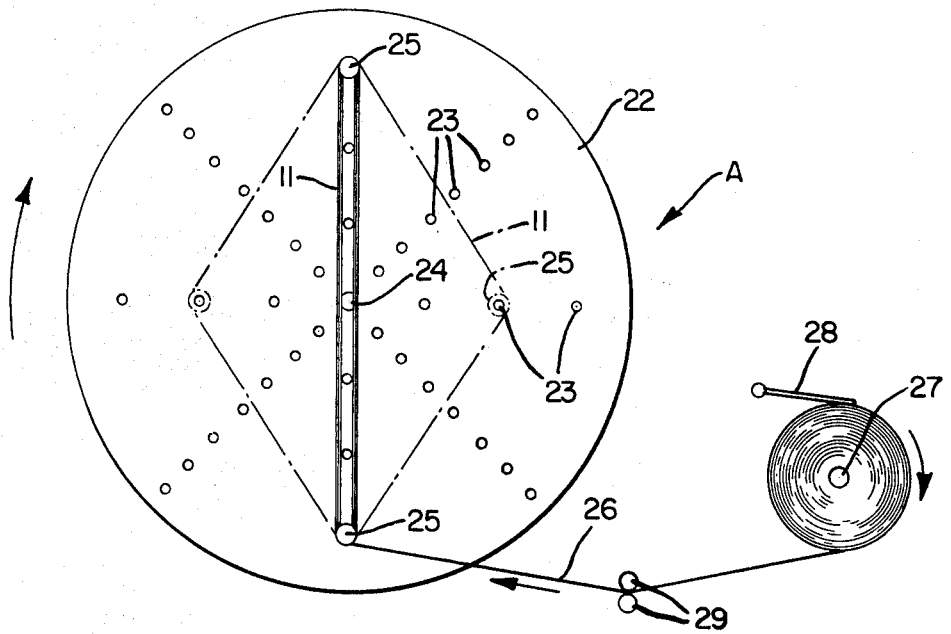
FIG. 5 is a schematic view in elevation of the apparatus used to make a cable in accordance with the present invention.
Figure 6:
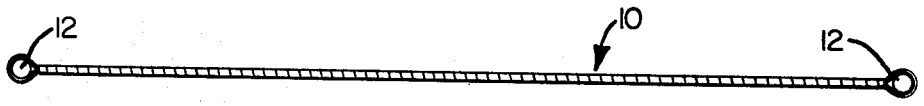
FIGS. 6 and 7 are side and plan views, respectively, of a completed electrical cable in accordance with the invention.
Figure 7:
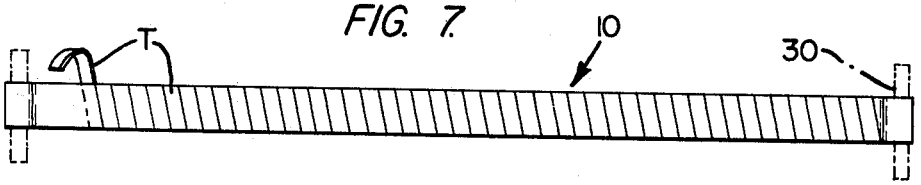
Figure 8:
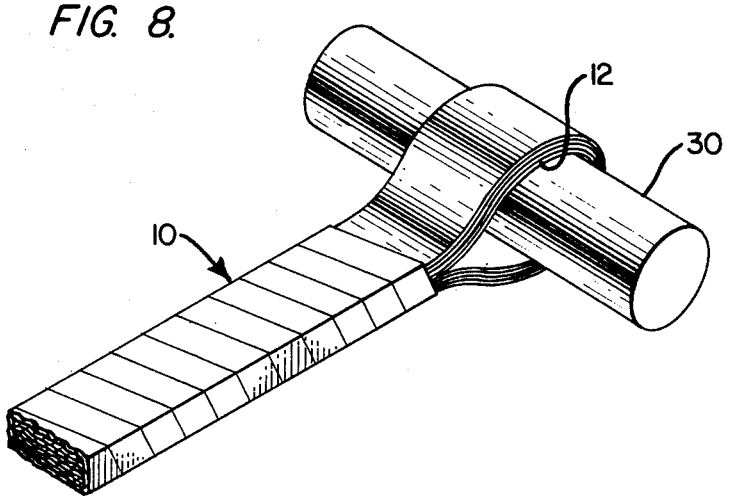
FIG. 8 is an enlarged, fragmentary, perspective view of a portion of the cable in accordance with the invention, with a plug inserted through the loop at the end thereof to retain the shape of the loop prior to use of the cable.

In FIG. 5, a portion of an apparatus for making the cable according to the invention is indicated generally at A, and comprises a substantially circular assembly wheel 22 having a plurality of apertures or openings 23 formed therein in spaced apart relationship around a central axis of rotation 24. A plurality of pegs 25 are placed in a selected number of the apertures 23 in a predetermined spaced relationship, and a strip 26 of silver foil is engaged with the pegs 25, and the wheel 22 is then caused to rotate, whereby the pegs rotate as a unit about the axis of rotation 24, and the strip 26 of silver foil is wound on the spaced apart pegs 25, thus forming a plurality of laminated loops 11 of silver foil. The strip 26 of silver foil may be fed from a suitable spool 27 or the like if desired, having an anticoast brake 28 associated therewith to prevent freewheeling or overrunning of the spool 27, and a tension brake means 29 is operatively engaged with the strip of foil to insure that the foil is wound tightly upon the pegs 25. If desired, the laminated loops of silver foil may then be helically wrapped between the opposite ends thereof with a strip of tape T or other suitable material, as desired, and in order to retain the shape of the looped end of the cable, plugs 30 may be inserted therein.

Although the cable has been described herein as comprising a continuous strip of silver foil to provide maximum power transfer, it could be made of other suitable materials, if desired. Additionally, the spring clip provides maximum security to the cable connection with the electrical connector, with a minimum amount of weight, and it also provides a cable to lug or connector attachment, which is much more simple and quick to effect than prior art devices. Additionally, the cable and spring clip of the invention can be installed and removed with the fingers, and does not require the use of any tools.

In addition to the applications described herein, it should be apparent that there are many other applications for the invention, using different materials for special applications, such as, for example, with standard automobile batteries and the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A lightweight electrical cable comprising:

a plurality of continuous flat strips of silver foil formed in layers one upon the other, with the innermost one of said flat strips being folded back on itself to form an elongated structure having the fold at one end thereof and a pair of confronting faces which contact each other for a predetermined length of said elongated structure, said confronting faces being spaced apart in non-contacting relationship with each other adjacent said one end to form a loop thereat, said loop having an inner transverse dimension sufficient to receive an electrical conductor therein with said electrical conductor oriented to extend axially of said loop with the confronting faces which form the inner surface of said loop contacting said electrical conductor to form an electrical connection between said one strip and said electrical conductor.

2. The electrical cable of claim 1 wherein said innermost strip has electrically conductive back faces oriented to be presented away from said confronting faces, and further including a second strip which is folded back on itself to form a second elongated structure having the fold at one end thereof and a pair of electrically conductive confronting faces and a loop adjacent said second strip one end, said second strip being laminated onto said first strip with said second strip confronting faces in electrical contact with said first strip back faces for substantially the entire length of said strips.

3. A cable as in claim 1, wherein a strip of tape is helically wound around the laminated loops of foil securing them tightly together throughout most of the length of the cable, and the opposite ends of the cable are free of tape and the laminated loops define electrical connector receiving openings at opposite ends of the cable.

4. A cable as in claim 1, wherein the laminated loops define an opening at each end of the cable, and the length of cable between the opposite ends is helically wrapped with tape to tightly hold the laminations together between the opposite ends thereof.

5. In combination, an electrical cable and fastening means releasably securing the cable to an electrical connector, said cable comprising a plurality of loops of a continuous strip of silver foil laminated together and wound about each other to define an elongated structure defining an opening at least at one end of said elongated structure in which an electrical connector post is received, and said fastening means comprising a one-piece spring clip having opposite arcuate jaws disposed in closefitting clamping relationship over the cable end received on the post to releasably retain the cable on the post and obtain a secure electrical connection therebetween, said clip further including spaced apart finger engaging portions extending from the jaws whereby the finger engaging portions may be grasped and squeezed toward one another to move the jaws apart and release the cable.

6. The combination as defined in claim 5, wherein the post is circular in cross section and has a pair of axially spaced apart circumferential shoulders thereon defining an annular cable receiving recess therebetween, and said cable end received in said recess.

7. The combination as defined in claim 6, wherein the width of the recess is substantially the same as the width of the cable end received therein, such that opposite edges of the cable engage against the shoulders and thus prevent arcing therebetween.

8. The combination as defined in claim 5, wherein the spring clip comprises spring steel.

9. The combination as defined in claim 8, wherein the spring clip comprises a continuous length of spring steel formed such that the opposite ends thereof define the spaced apart finger engaging portions, and the length of spring steel between the opposite ends thereof is bent back upon itself at the opposite finger engaging portions to define opposed, spaced apart jaw ends, and the jaw ends are joined by a circular loop which engages the electrical connector.

* * * * *